United States Patent [19]

Ben-Dov

[11] Patent Number: 4,654,962

[45] Date of Patent: Apr. 7, 1987

[54] METHOD OF FABRICATING DOUBLY-TRUNCATED CIRCULAR WAVEGUIDE

[75] Inventor: Oded Ben-Dov, Marlton, N.J.

[73] Assignee: Sola Basic Industries, Inc., Stamford, Conn.

[21] Appl. No.: 739,427

[22] Filed: May 30, 1985

[51] Int. Cl.[4] ..... H01P 11/00

[52] U.S. Cl. ..... 29/600; 138/115; 333/242

[58] Field of Search ..... 29/600, 416; 138/115, 138/116; 228/152, 173.7; 174/95

[56] References Cited

U.S. PATENT DOCUMENTS

| | | | |
|---|---|---|---|
| 2,783,440 | 2/1957 | Lovick, Jr. | 333/239 |
| 3,625,258 | 12/1971 | Phelps | 138/115 |
| 4,494,094 | 1/1985 | Spinner et al. | 29/600 X |

FOREIGN PATENT DOCUMENTS

| | | | |
|---|---|---|---|
| 732423 | 2/1943 | Fed. Rep. of Germany | 333/242 |
| 892005 | 8/1953 | Fed. Rep. of Germany | 333/242 |
| 2031904 | 1/1972 | Fed. Rep. of Germany | 228/152 |
| 24338 | of 1895 | United Kingdom | 138/115 |
| 1202 | of 1904 | United Kingdom | 138/116 |

*Primary Examiner*—Mark Rosenbaum
*Assistant Examiner*—Carl J. Arbes
*Attorney, Agent, or Firm*—Robert R. Hubbard; Milton E. Kleinman; John Ohlandt

[57] ABSTRACT

A waveguide having reduced windloading yet a relatively wide bandwidth for the dominant mode of propagation comprises an elongated cylinder having substantially parallel plates forming an interior waveguide portion which in cross-section is a doubly-truncated circle. The plates are symmetrically disposed about the central axis of the elongated cylinder.

4 Claims, 7 Drawing Figures

METHOD OF FABRICATING DOUBLY-TRUNCATED CIRCULAR WAVEGUIDE

FIELD OF THE INVENTION

The present invention relates to a novel waveguide structure having a low windload exterior portion and an interior portion having a relatively wide bandwidth for the dominant mode of wave propagation.

BACKGROUND OF THE INVENTION

In order to transmit maximum allowable power, broadcast antennas should be placed at the highest possible location, as for example, on top of a hill or a tower. Such towers may be up to 2,000 feet in height in order to give the best line-of-sight to the distant viewers. The transmitter, which produces the high-power broadcast signal, is a large structure and is necessarily located on the ground. The high-power signal must be carried from the transmitter up the tower to the feed point at the base of the antenna. VHF (54–88 MHz and 174–216 MHz) and UHF (470–890 MHz) broadcast television signals are ordinarily carried by transmission lines, which are signal conductors designed to minimize signal losses between a source and a load. At UHF frequencies, waveguides are used for carrying the signal from the transmitter to the antenna since a waveguide is particularly well suited to handle the relatively high-power signals associated with television broadcasting with a minimum of signal attenuation.

At present, for high power UHF-TV applications there are only two types of waveguides to choose from, i.e., either hollow circular waveguide or rectangular waveguide. Rectangular waveguide is advantageous since it offers a relatively wide bandwidth for the dominant mode of signal propagation and substantially no propagation of the cross-polarized dominant modes. Thus, video signal distortion due to the appearance of cross-polarized modes is minimal. However, due to the flat exterior sides of rectangular waveguide, very high lateral forces are presented to the antenna tower due to windloading, thereby requiring a more sturdy, and therefore more costly, antenna tower.

On the other hand, hollow circular waveguide has an exterior which is optimum for minimizing the effect of windloading on the antenna tower. However, unavoidable flexing and asymmetries in circular waveguide due to windloading on the waveguide itself lead to the generation of undesirable cross-polarized mode propagation and resulting video signal distortion. Cross-polarized modes effectively swing the principal plane of polarization, i.e., the dominant mode of the electromagnetic energy propagating through the waveguide, from the desired plane to a plane intermediate the desired plane and the plane of the cross-polarized mode. If an electric probe or magnetic loop is used for coupling energy from the end of the waveguide to the antenna, rotation of the polarization plane results in reduction of the power available to the antenna and also results in reflection of the remainder of the power back to the transmitter. The latter can result in undesirable picture distortion.

Thus, it is desirable to provide a waveguide which combines the relatively low windloading of hollow circular waveguide with the stable dominant mode transmission characteristics of hollow rectangular waveguide.

SUMMARY OF THE INVENTION

Toward the above ends, in accordance with the principles of the present invention, a waveguide structure comprises an elongated cylinder having substantially parallel plates forming an interior waveguide portion which in cross-section is a doubly-truncated circle. The plates are symmetrically disposed about the central axis of the elongated cylinder.

DETAILED DESCRIPTION OF THE INVENTION

Figure 1:
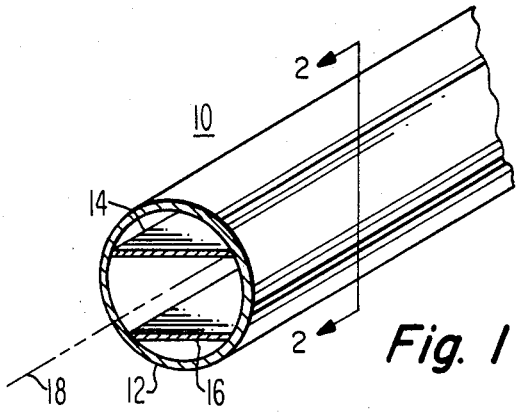
FIG. 1 illustrates a perspective view of a waveguide according to the present invention.
Figure 2:
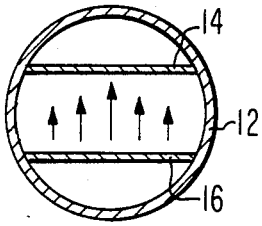
FIG. 2 illustrates a cross-section view of the waveguide of FIG. 1.

As illustrated in FIG. 1, a waveguide 10 comprises a hollow, elongated, cylindrical cylinder 12 as its exterior portion and includes elongated flat plates 14 and 16 disposed symmetrically about a central axis 18 of cylinder 12. For propagating signal energy within waveguide 12, at least plates 14 and 16 and the arcuate portions of cylinder 12 located between plates 14 and 16 must be electrically conductive. Therefore, signal propagation is confined within the conductive area bounded by and including plates 14 and 16 and, as illustrated by arrows in the FIG. 2 cross-section view, readily supports a dominant mode similar to the $TE_{10}$ mode propagated in rectangular waveguide. Signals can be coupled into or out of the signal propagating portion of the waveguide using conventional electronic probe or magnetic loop techniques.

As previously noted, dominant mode signal propagation of rectangular waveguide is preferred for television broadcasting due to its durability in maintaining its dominant polarization mode throughout its length. This durability results in reduced signal distortions and a maximization of the coupling of signal energy to the antenna. Since the exterior of waveguide 10 has a circular cross-section, its windloading on the antenna tower is minimized, allowing the use of a less costly tower and waveguide flexing is reduced. Furthermore, signal distortions which result from waveguide flexing are also minimized due to the reduced windloading and to the stable dominant mode propagation characteristic of the interior cross-section.

In summary, waveguide structure 10 has a circular exterior cross-section which minimizes windloading and a doubly-truncated circular interior cross-section which propagates signal energy in a manner similar to rectangular waveguide.

Figure 3A:
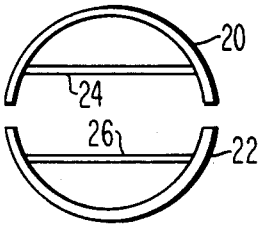
FIGS. 3*a* and 3*b* illustrate two methods for manufacturing the waveguide of FIG. 1.

FIG. 3*a* illustrates a cross-section view of one method of manufacturing the waveguide of FIG. 1. The starting material is a elongated conductive circular cylinder longitudinally cut in half to form two half-circular portions 20 and 22. Equal width elongated flat conductive plates 24 and 26 are conductively attached along their elongated edges to the interior of respective ones of half-circular portions 20 and 22. The two portions 20 and 22 are then conductively joined along their peripheral edges for completing the waveguide structure. The conductive attachment can typically be by welding.

Figure 3B:
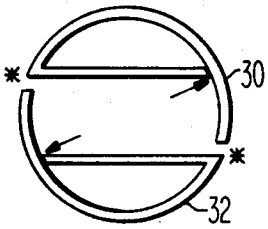

FIG. 3*b* illustrates an alternative manufacturing technique wherein the number of required weld areas is reduced to four. In this technique, two elongated flat conductive plates are bent into identical waveguide portions having cross-sections illustrated as 30 and 32, respectively. Each portion has one end welded along a line, indicated by the arrows, to its interior wall. Portions 30 and 32 are then welded together along a line, indicated by the asterisks, for completing the novel waveguide structure.

Figure 4A:
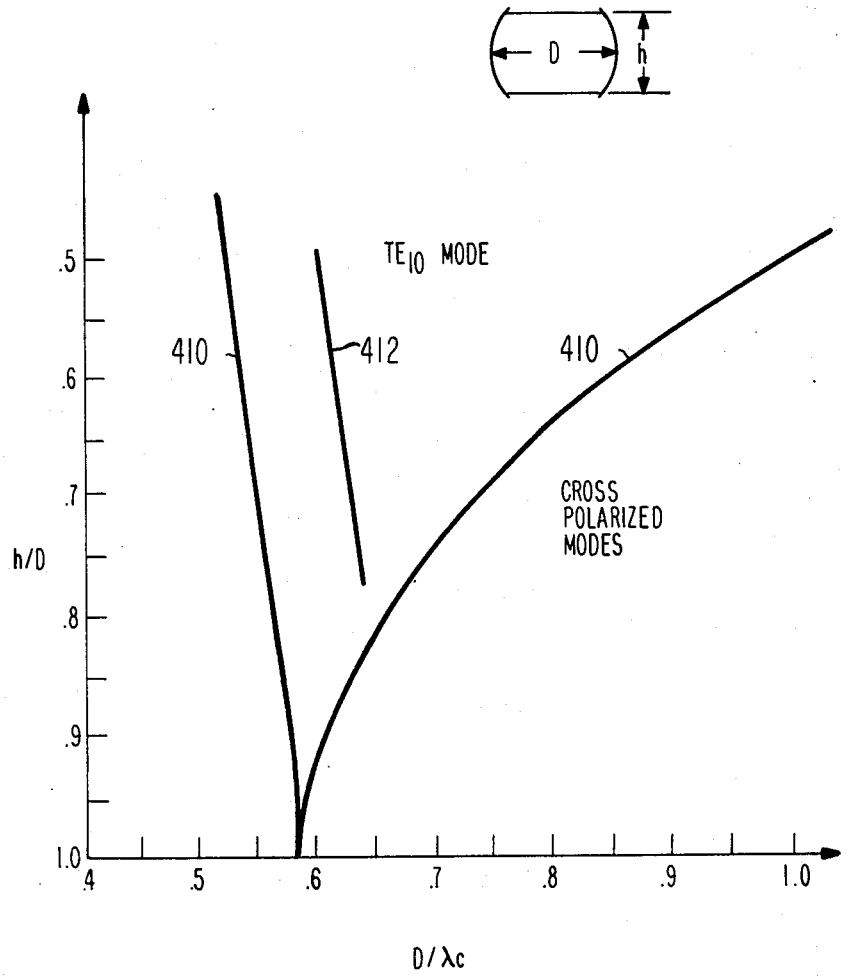
FIGS. 4*a*, 4*b* and 4*c* illustrate graphs useful for designing waveguide according to the invention.
Figure 4B:
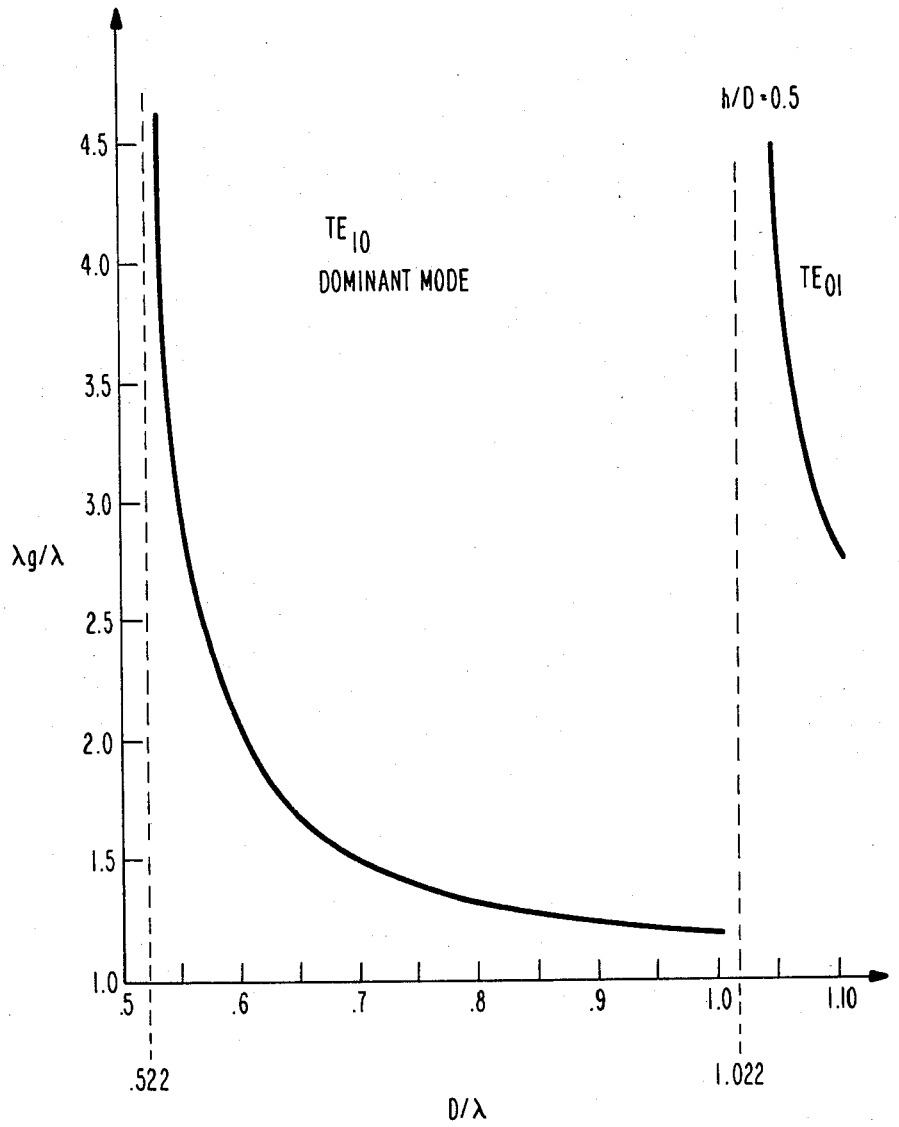
Figure 4C:
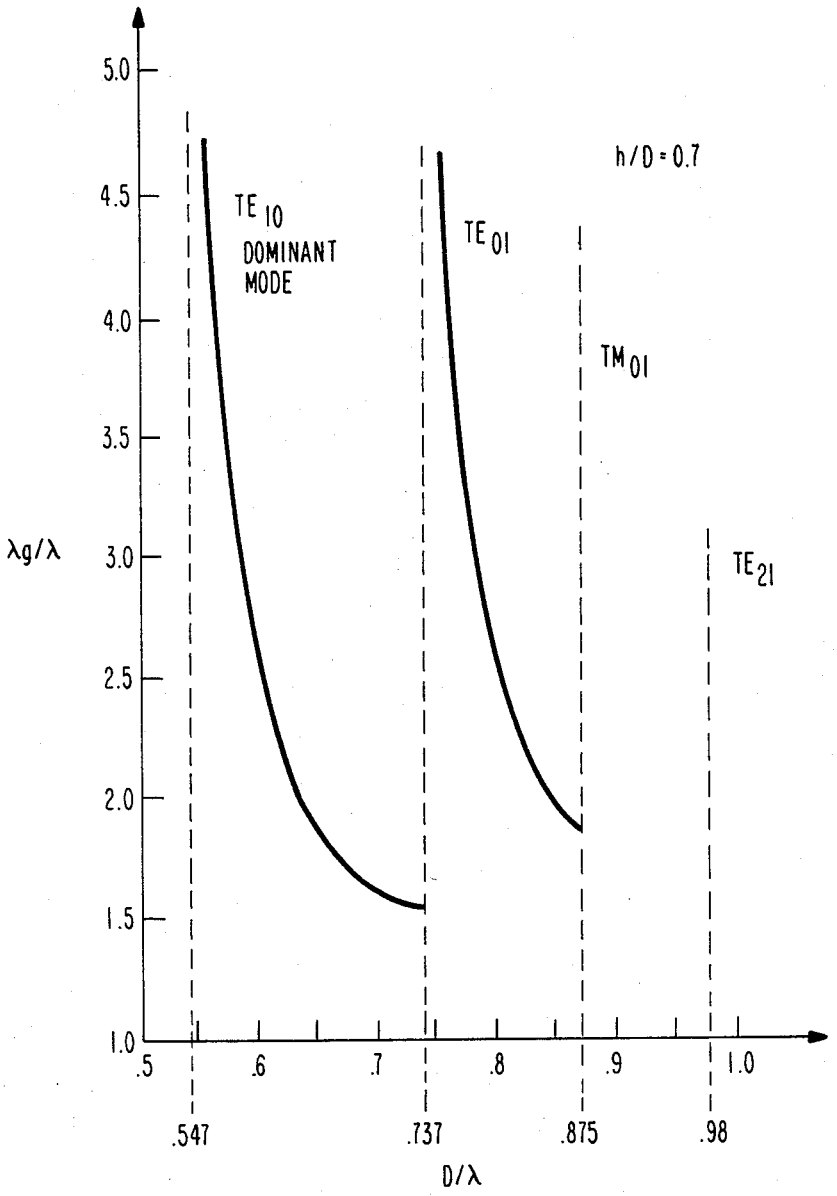

FIGS. 4*a*, 4*b* and 4*c* were determined experimentally and provide design information concerning bandwidth, attenuation and elimination of unwanted propagation modes.

The graph of FIG. 4*a* has as its ordinate the factor h/D, which is the ratio of the distance (h) between plates 14 and 16 of FIG. 1 and the interior diameter (D) of the circular cross-section, and as its absissa the factor $D/\lambda_c$, which is the ratio of the diameter (D) and the cutoff wavelength $\lambda_c$. The area inside a curve 410 represents the possible combinations of factors h/D and $D/\lambda_c$ which result in a dominant $TE_{10}$ mode of transmission through the novel double-truncated waveguide of the invention. As would be expected, the left-hand edge of curve 410 asymptotically approaches the 0.5 value for the factor $D/\lambda_c$ which is the cutoff wavelength of the $TE_{10}$ mode for rectangular waveguide. The area to the right of curve 410 represents those combinations of these factors which result in cross-polarized modes being propagated in the waveguide. Line 412 illustrates a maximum relative phase velocity of 2.0 within the waveguide. It is desirable to keep the relative phase velocity less than 2.0 (i.e., to the right of line 412) in order to reduce impedance value variation with frequency within the waveguide.

FIGS. 4*b* and 4*c* illustrate the variation of the factor $D/\lambda$ versus the wavelength factor $\lambda_g/\lambda$, for h/D factors of 0.5 and 0.7, respectively. As shown in FIG. 4*b*, the dominant $TE_{10}$ mode is propagated between $D/\lambda$ values of 0.522 and 1.022. Cross-polarized modes are propagated for $D/\lambda$ greater than 1.022. As shown in FIG. 4*c* the dominant $TE_{10}$ mode is propagated between $D/\lambda$ values of 0.547 and 0.737. Cross-polarized modes are propagated for $D/\lambda$ values greater than 0.737. For best results, the designer should stay at least 15% away from the cutoff wavelength when deciding on a $D/\lambda$ value.

Although a preferred embodiment of the present invention has been illustrated, other embodiments are possible. For example, instead of a smooth circular exterior for the waveguide, an exterior having a cross-section with a piecewise approximation to a circle, such as an octagonal cross-section, could be used. The octagonal exterior would still have a significant advantage over rectangular waveguide with respect to minimizing windload. Furthermore, since it is only required that the interior portion having the doubly-truncated circular cross-section be fabricated with a conductive material, the truncated portions of the circular cylinder, which are exterior to the portion of the waveguide which actually carries the electrical signal, could be fabricated out of nonconductive material and added to the flat plates of the interior portion of the waveguide for completing its circular exterior. Finally, a waveguide structure embodying the invention could be constructed by placing a doubly-truncated circular waveguide in a round pipe. This would result in about a 10% smaller pipe diameter than if a rectangular waveguide designed for the same frequency was placed inside a round pipe, due to the curved sidewalls of the inventive waveguide. The smaller diameter pipe would result in a reduced cost of materials and lower windloading. These and other modifications are intended to be within the scope of the following claims.

What is claimed is:

1. A method for fabricating waveguide, comprising the steps of:

forming an elongated conductive circular cylinder having an axis;

cutting said elongated conductive circular cylinder along a plane passing through said axis to form first and second complete half-circular portions;

forming first and second elongated conductive plates having a width less than the diameter of said circular cylinder;

conductively attaching said first flat conductive plate along its elongated edges to the interior of said first half-circular portion with said first plate parallel with said axis;

conductively attaching said second flat conductive plate along its elongated edges to the interior of said second half-circular portion with said second plate parallel with said axis; and conductively joining the cut edges of said first and second half-circular portions to define a closed conductive waveguide including a pair of spaced-apart parallel plane walls and a pair of spaced-apart curved walls.

2. A method according to claim 1 wherein said steps of conductively attaching and conductively joining include a welding step.

3. A method according to claim 1 wherein said steps of conductively attaching further comprise the steps of orienting said first and second flat conductive plates so that they will be parallel after said step of conductively joining.

4. A method for fabricating waveguide, comprising the steps of:

bending an elongated rectangular conductive plate along a longitudinal line parallel with the long edges of said plate to form a structure having a cross-section which includes an arcuate portion extending from said longitudinal line to one of said long edges of said plate, said arcuate portion defining a segment of a curve, and also including an acute bend along said longitudinal line to define a flat portion extending from said longitudinal line to the other side of said long edges of said plate, said other long edge being adjacent the interior of said arcuate portion;

welding said second long edge to said interior of said arcuate portion to define a first elongated half-waveguide;

forming a second half-waveguide similar to said first half-waveguide; and positioning said one long edge of said first half-waveguide adjacent the longitudinal line of said second half-waveguide and the one long edge of said second half-waveguide adjacent said longitudinal line of said first half-waveguide; and welding each of said longitudinal lines to the adjacent one long edge.

* * * * *